US008707863B2

(12) United States Patent
Zitzmann

(10) Patent No.: US 8,707,863 B2
(45) Date of Patent: Apr. 29, 2014

(54) STRAPPING MACHINE AND METHOD OF OPERATING SAME

(75) Inventor: Andreas Zitzmann, Schwelm (DE)

(73) Assignee: Titan Umreifungstechnik GmbH & Co. KG, Schwelm (DE)

( * ) Notice: Subject to any disclaimer, the term of this patent is extended or adjusted under 35 U.S.C. 154(b) by 261 days.

(21) Appl. No.: 13/225,499

(22) Filed: Sep. 5, 2011

(65) Prior Publication Data

US 2012/0055352 A1 Mar. 8, 2012

(30) Foreign Application Priority Data

Sep. 8, 2010 (EP) ..... 10175728

(51) Int. Cl.
*B65B 13/04* (2006.01)

(52) U.S. Cl.
USPC ..... 100/26; 100/2; 100/29; 100/32; 53/589

(58) Field of Classification Search
USPC ..... 100/2, 26, 29, 32, 589; 53/589
See application file for complete search history.

(56) References Cited

U.S. PATENT DOCUMENTS 3,031,949 A * 5/1962 Daniels et al. ..... 100/26
3,060,840 A * 10/1962 Van De Bilt ..... 100/26
5,078,057 A * 1/1992 Pearson ..... 100/25
5,111,634 A 5/1992 Rauch
7,086,213 B2 * 8/2006 Stauber ..... 53/589
7,207,161 B2 * 4/2007 Belmann et al. ..... 53/589

FOREIGN PATENT DOCUMENTS

DE EP2116470 A1 * 11/2009 ..... B65B 13/06
EP 2116470 A 11/2009

* cited by examiner

*Primary Examiner* — Shelley Self
*Assistant Examiner* — Onekki Jolly
(74) *Attorney, Agent, or Firm* — Andrew Wilford

(57) ABSTRACT

A machine for wrapping a strap in one or two loops around a package has a support frame and first and second upright generally annular strap-guiding channels. The channels each have confronting ends defining a respective gap that are immediately adjacent each other, and the package is engageable within the annular channels. A single-loop guide fittable in the gap of the first channel has a guide groove extending in a single-loop mode between the ends of the first channel. A double-loop guide fittable in a dual-loop mode in the gaps of the first and second channels has first and second crossing guide grooves that extend between one of the ends of the first channel and one of the ends of the second channel and the second guide groove extending between the other of the ends of the first channel and the other of the ends of the second channel.

5 Claims, 5 Drawing Sheets

STRAPPING MACHINE AND METHOD OF OPERATING SAME

FIELD OF THE INVENTION

The present invention relates to a package-strapping machine and method of operating the machine. More particularly this invention concerns a strapping machine and method that can apply one or two loops of strapping to the package.

BACKGROUND OF THE INVENTION

A standard double- or multiple-loop strapping machine has two or more strap-guiding channels and at least one guide. The strap-guiding channels meet at a sealing head and so that one channel feeds into the other to form multiple loops around the package with a single piece of strapping whose two ends can be fixed together.

A method and a corresponding strapping machine of the above-described structure are described in EP 2 116 470. As explained therein in detail, such machines usually serve for bundling objects or packages to be strapped. For this purpose, a seal head of the strapping machine is regularly positioned on the package to be strapped. Subsequently, the strap is guided around the package the requisite number of times and tensioned. At the end of the strapping process, the ends of the strap are connected to each other within the sealing head, typically by welding together the ends of the normally thermoplastic strap. This is generally carried out in a firmly bonded or form-fitting manner. The strap coming from a supply roll is cut off and the sealing head is lifted off the package. Consequently, at the end of the described procedure, the package can be removed from the strapping machine. This principle has proven itself.

In this prior art system according to EP 2 116 470, the strap is guided several times around the package to be strapped. Hence, two strap loops are formed that cross at an intersection, normally on a side of the package opposite where the strap ends are welded together. The strap-guiding channels are connected where the straps intersect via an intersection block that is functions as a guide.

U.S. Pat. No. 5,111,634 describes a packaging station of a packaging machine in which a stack of goods is strapped with a packaging strap. For this purpose, a work table for receiving the stack of goods is provided. In addition, a guide is provided for guiding the packaging strap around the stack of goods. The work table is at least partly formed by a turntable that is rotatable about an axis and has at least four sectors. The sectors have at least two belts that extend diametrically or secantally of the rotational axis, at least one of which is set in a guide groove. This way, the stack of goods can be strapped with a plurality of intersecting packing straps.

However, in practice some packages, in particular small ones, do not require multiple strapping. This means, depending on dimension and configuration of the package, a flexible attaching of the strap is required, which can not be provided in this consequence by the present prior art.

OBJECTS OF THE INVENTION

It is therefore an object of the present invention to provide an improved package-strapping machine.

Another object is the provision of such an improved package-strapping machine that overcomes the above-given disadvantages, in particular that can be used to apply single or multiple loops of strapping to the package, which can itself be formed by a single or multiple objects.

A further object is to provide such an apparatus that can be readily switched, for instance, between single-strap and double-strap mode, and to provide an improved method operating such an apparatus.

SUMMARY OF THE INVENTION

A machine for wrapping a strap around a package has according to the invention a support frame and first and second upright generally annular strap-guiding channels generally parallel to and flanking an upright plane. The channels each have a pair of confronting ends defining a respective gap that are immediately adjacent each other, and the package is engageable within the annular channels. A single-loop guide fittable in the gap of the first channel has a guide groove extending in a single-loop mode between the ends of the first channel. A double-loop guide fittable in a dual-loop mode in the gaps of the first and second channels has first and second crossing guide grooves that extend between one of the ends of the first channel and one of the ends of the second channel and the second guide groove extending between the other of the ends of the first channel and the other of the ends of the second channel. A strap is supplied to the first channel such that, when the single-loop guide is in the single-loop mode in the gap of the first channel, the strap passes only around the first channel and forms therein a generally closed first loop and, when the double-loop guide is in the dual-loop mode in the gaps of both channels, forms first and second loops in the first and second channels. The strap is tensioned around the package engaged within the channels and sealed together at a location offset from the gaps.

A strap-guiding channel in the context of the invention means any guiding means for an associated strap by means of which the strap is guided around the package to be strapped. Typically, the two or more strap-guiding channels are configured in a manner as described in EP 2 116 470. This means that the strap is fixed in most cases between a clamp jaw and a support jaw of the strap-guiding channel and, by a rotation of the strap-guiding channel about its rotational axis, can define one or more strap loops. Since within the context of the invention two or more strap-guiding channels are provided that are spaced apart from each other, it is possible with the described strapping machine to do at least a double strapping.

However, of particular importance is the fact that according to the invention, optionally, single strapping or even multiple strapping, meaning triple, quadruple strapping etc. can be provided. To this end, the strapping machine and the described method can be flexibly adapted to the package, in particular with respect to its length, its dimensions, its weight, the material of the straps, etc.

For this purpose, the guide can engage within the context of a first alternative at least one end point of a strap-guiding channel. The end point of the one strap-guiding channel is typically connected to another end point of the strap-guiding channel, which end point is arranged opposite with respect to the already mentioned intersection block. Within the context of the invention, the end point can be moved by the guide toward one of the already mentioned strap-guiding channels or toward another (further or third) strap-guiding channel.

In other words, if required, the guide provides that, in the meaning of a single strapping, the strap is guided within one and the same strap-guiding channel around the package. However, apart from that it is also possible and conceivable that the guide displaces the at least one end point of the respective strap-guiding channel in such a manner that after one circulation while defining a first strap loop at an intersection and after passing the intersection block, the strap runs into the other strap-guiding channel for defining the adjacent second strap loop and thus straps the package twice.

According to an advantageous configuration, a plurality of guides may be provided that engage at associated end points of the at least one strap-guiding channel. The two end points face each other directly or are arranged joint-to-joint to each other. However, it is principally also possible to interpose the already mentioned intersection block. In any case, there is the possibility to align the at least two strap-guiding channels by means of the one or the plurality of guides on the one side for a single strapping and on the side for double or multiple strapping.

In the first-mentioned case, the one or the two guides provide that the respective end points of the one strap-guiding channel face each other and adjoin each other. If required, a suitable guide part can be interposed between the two end points. As a result of this configuration, the package receives a single strapping.

In the case of double strapping, the displaceable guide provides that the end point of the one first strap-guiding channel is aligned with the end point of the other second strap-guiding channel. This can again be carried out such that the two end points oppose each other and are aligned joint-to-joint to each other. Likewise, a guide part or, in this case, an intersection block can be interposed again. This way, a further second strap loop is defined. Since in case of double strapping, the strap is guided at an intersection from the second strap-guiding channel back into the first strap-guiding channel, the guide has to ensure, if required, that the two end points on the outgoing side or the starting points of the first and second is strap-guiding channel are also aligned with each other and arranged joint-to-joint.

All these functional positions can be provided without difficulty for the case that the one or two strap guides are configured in a flexible manner, namely at least at their respective end points or starting points at which the one or more guides engage. Usually, the strap guides are configured to be completely flexible.

This flexibility can be achieved by assembling the respective strap-guiding channel from two or more channel segments that are movable relative to each other. Within the context of an advantageous configuration, the channel segments are coupled to each other by flexible connectors. Moreover, it is within the context of the invention that the guide engages not only at the respective end point of the strap-guiding channel, but to design the guide in such a manner that the entire strap-guiding channel can be involved if required. In this case, the guide extends along the respective strap-guiding channel. The strap-guiding channel is in this case a flexible channel that can be adjusted by the guide.

For displacing the guide, it is usually equipped with an actuator. The actuator can be a synchronous servomotor, a recirculating-ball actuator or the like. In each case, at least one displacement sensor is assigned to the guide or the associated actuator. In this manner, the guide can complete a predetermined adjustment travel and can be accurately guided back again into its initial position.

The one or more are advantageously placed at an optional or quasi-virtual intersection of different strap loops. Alternatively or additionally, an arrangement along the strap-guiding channel is also conceivable as already described. If the guide is arranged in or at the intersection, the guide typically lies opposite to a sealing head at which the two strap-guiding channels meet.

Within the context of an alternative approach, the displaceable guide is equipped with different guide slots and quasi replaces the stationarily designed intersection block according to EP 2 116 470. For this purpose and depending on the type of desired strapping, the individual guide slots can be moved between spaced respective end points of the strap-guiding channel that is to be closed by the guide slot. If, for example, a single strapping within the context of the invention is intended, a straight and continuous guide slot is used that interconnects the two end points of one and the same strap-guiding channel and subsequently closes the one (single) strap-guiding channel. For this, the guide slot may be designed arcuate because the two end points extend at an obtuse angle between to each other so as to ensure, in connection with the second adjacent strap-guiding channel, a double strapping.

In the event of the desired double strapping, the second guide slot in the form of the above-described intersection block is used. Thus, in order to double-strap, the guide having the two different guide slots is displaced transverse to the guide plane in such a manner that now the four end points of the two adjacent strap-guiding channels to be connected are coupled to each other by the second guide slot in the form of the intersection block and each of the two strap-guiding channels is closed.

As a result, a method of strapping a package and an additional strapping machine are provided that, for the first time, provide a flexible adaptation of the strapping to actual requirements. Depending on dimension and weight of the package to be strapped, the type of strap, etc., it is possible to optionally operate with a single strapping, a double strapping or even a multiple strapping in the meaning of a triple strapping, quadruple strapping, etc. The present prior art is far away from such a flexibility.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

DETAILED DESCRIPTION

Figures 1, 1A:
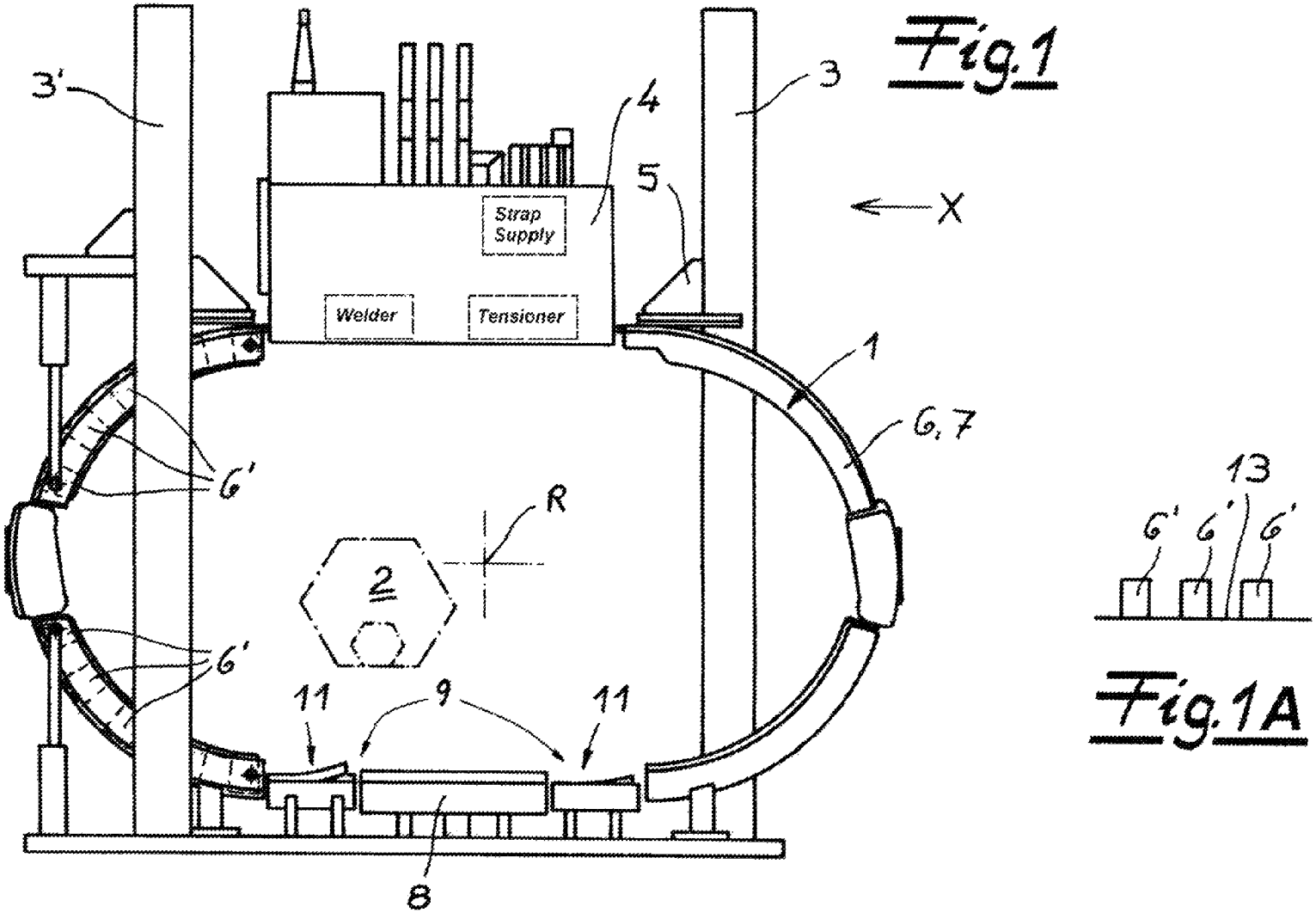
FIG. 1 is a front view of a strapping machine according to the invention.
FIG. 1A is a view of a detail of FIG. 1.
Figure 2:
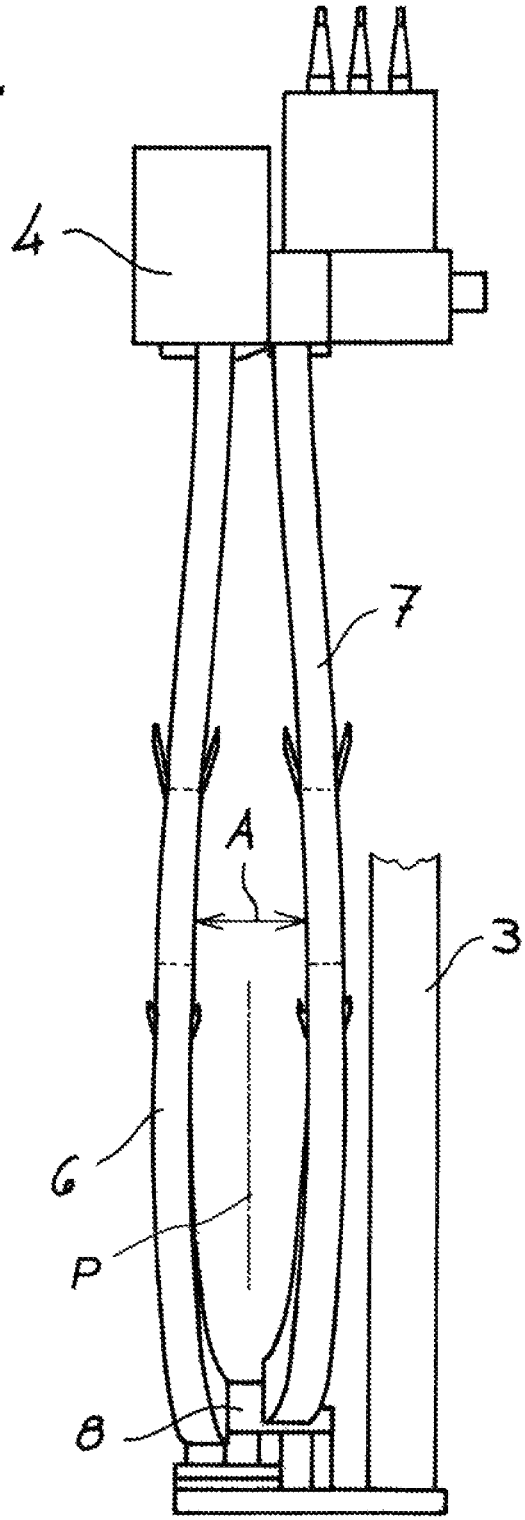
FIG. 2 is an end view of the machine taken in the direction of arrow X of FIG. 1.

FIG. 1 shows a strapping machine that can wrap a strap 1 around one or more packages 2. To this end, the strapping machine has a support frame 3, 3' with two vertical columns 3 and 3'. A bracket 5 is vertically movable on to the column 3 and carries a housing 4 holding a sealing head and strap supply. First and second strap-guiding generally annular channels 6 and 7 are connected to the sealing head 4 as shown in FIG. 2. Both strap-guiding channels 6 and 7 extend annularly around the package 2, flanking a vertical center plane P (FIG. 2)*and* generally centered on an axis R perpendicular to this plane P.

The two strap-guiding channels 6 and 7 are spaced from each other at a maximum spacing A as shown in the end view of FIG. 2. They may operate in the manner described in EP 2 116 470, herewith incorporated by reference. In any case, the strap 1 is guided in the strap-guiding channels 6 and 7 to orbit in an elliptical path about the axis R around the package 2 so that, when tension is applied to the strap 1 by a tensioning unit also held in the housing 4, it is pulled toward the axis R into tight engagement with an outer surface of the package 2. Outer ends of the strap 1 are interconnected in the sealer in the housing 4 for example by welding or in a different manner. Prior to this, the strap 1 is tensioned as basically known and described in detail in above-mentioned EP 2 116 470.

The lower regions of the two generally annular strap-guiding channels 6 and 7 have ends 11 that are spaced from and open toward each other, forming gaps 9. According to the invention these ends 11 can be connected together in two manners, for single-loop or double-loop strapping of the package 2 by a guide assembly 8 that can be constituted either as shown in FIGS. 3 and 5 or as shown in FIG. 4.

Figure 3:
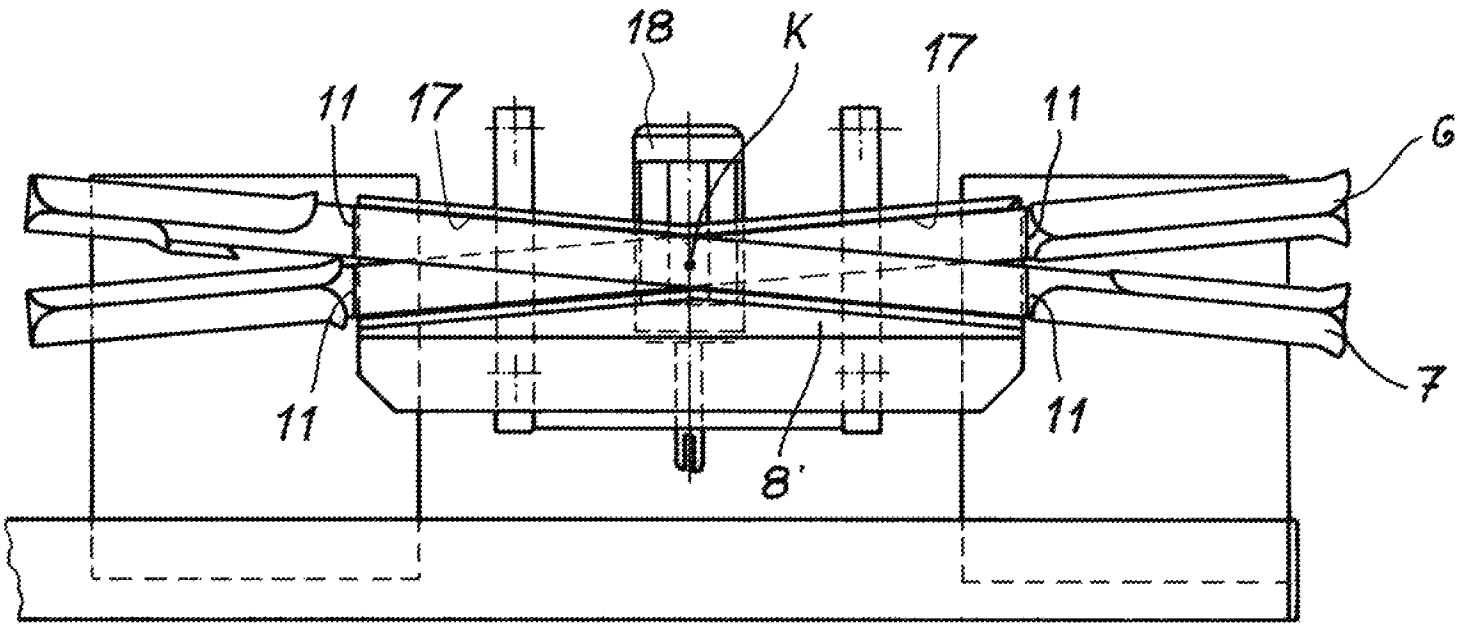
FIG. 3 is a detail top view of the machine of FIG. 1 showing the guide thereof at an intersection of two formed strap loops.
Figure 4:
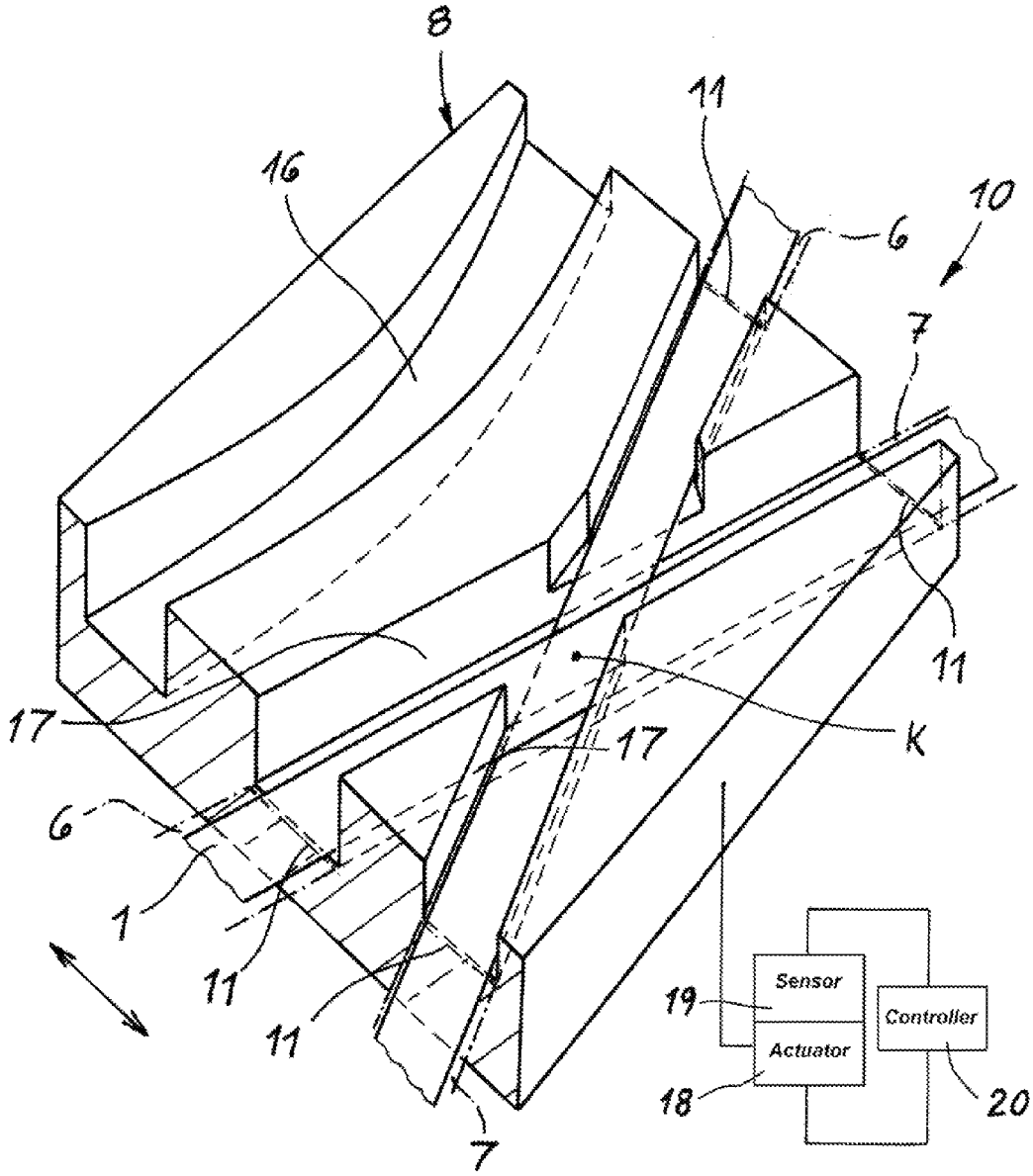
FIG. 4 is an enlarged perspective view of another guide according to the invention.
Figure 5:
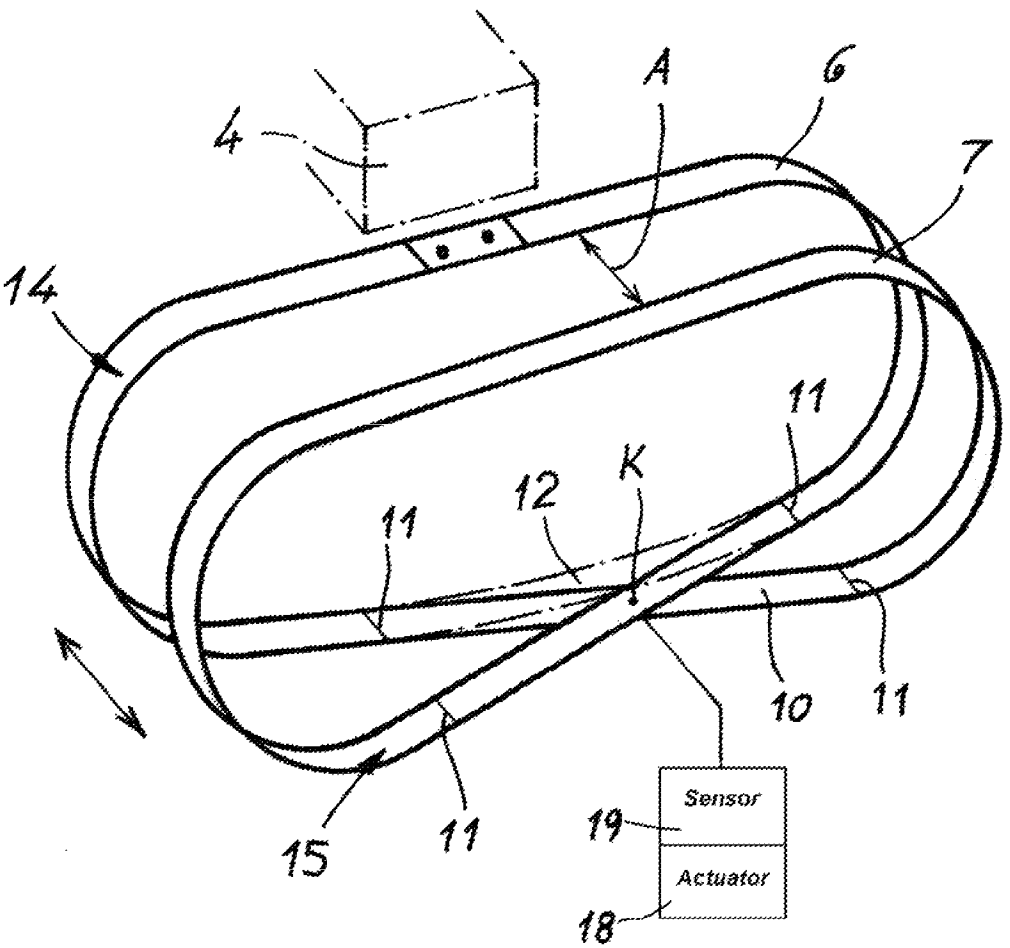
FIG. 5 is a schematic view showing different loop configurations s producible by the strapping machine according to the invention.

According to FIGS. 3 and 5 the guide assembly 8 comprises a single guide block 8' formed with a pair of upwardly open grooves 17 that cross at a point K and that can be transversely shifted by an actuator 18 between the position shown in FIG. 3 in which it feeds the strap 1 from one end 11 of the first channel 6 to an end 11 of the second channel 7 and, after the strap 1 passes completely around the second channel 7, from the other end 11 of this channel 7 to the other end 11 of the channel 6, whence it goes up to the welder in the housing 4. Thus when this block 8' is in this position, two loops 14 and 15 are formed around the package. Subsequently these loops 14 and 15 are pulled tight around the package, are welded together, and are cut from the strap supply in the housing 4 as is well known in the art.

Alternately as shown in FIG. 5 the actuator 18 can shift the guide block 8' out of the way and a straight guide 12 can be fitted between the ends 11 of the first guide 6. In this case the strap 1 will pass in a single loop 14 around the package 2, as is preferred for a smaller package. To this end the ends 11 of the strap guide channel 6 are shifted from a position extending at a large obtuse angle from each other to one with the two ends 6 of the channel 6 extending parallel to the plane P and projecting directly at each other.

The embodiment of FIG. 3 has a guide assembly 8 formed by a one-piece block 10 formed like the block 8' of FIG. 3 with two crossing straight guide grooves 17, one of which is slightly deeper than the other, and thereadjacent with an arcuate guide groove 16. When the two crossing grooves 17 are aligned with all four ends 11 of the two strap-guiding channels 6 and 7, dual loops 14 and 15 are formed around the package. When the single arcuate groove 16 is aligned between the two ends of the guide channel 6, which is connected at the top to the strap supply and to the welder, only a single loop 14 is formed in the first channel 6.

The two types of guide 8 can operate on the first strap-guiding channel 6 in the described manner because the strap-guiding channel 6 is flexible at least at the ends 11. In most cases, the strap-guiding channel is flexible over its entire length. In this connection as shown in FIG. 1A, in particular such configurations fall also within the context of the invention that have strap-guiding channels 6 and 7 formed of two or more segments 6' as shown in detail in FIG. 5. The channel segments 6' are interconnected by a flexible connectors 13. The connectors 13 may be formed by a spring-steel band serving at the same time as support for the strap 1 guided thereon.

It is apparent that in accordance with a predetermined position of the guide 8, the strapping band 1 can optionally be guided once or twice around the package 2. Of course, more than double-strapping is also conceivable. In any case, the guide 8 engaging at least one end point 11 of the strap-guiding channel 6 ensures that the end point 11 can be moved toward the other or the same strap-guiding channel 6 and 7. Within the context of the illustrated embodiment, the end point 11 of the first strap-guiding channel 6 on the right in FIG. 5 is directed toward and aligned with the second strap-guiding channel 7 and is displaced with the aid of the guide 8 toward the opposing first strap-guiding channel 6 or vice versa.

The one or two guides 8 are arranged at the optional intersection K. This intersection K is more or less a virtual point because, as described, a single strapping is also possible without the intersection K. The intersection K is opposite the sealing head 4. Moreover, in case of a double or multiple strapping, two or more of the already mentioned strap loops 14 and 15 are formed.

The actuator 18 may be a servomotor or the like. Of particular importance is the fact that a sensor 19 is connected to the actuator 18. The sensor 19 usually is a displacement transducer or a displacement sensor. In this manner, the adjustment stroke covered by the actuator 18 or the guide 8 can be detected and, after its displacement, the guide 8 can be accurately guided back into its starting position. To this end, the actuator 18 and the displacement sensor 19 may be connected to a controller 20 that determines the already described displacements of the guides 8 and ultimately defines the type of strapping, namely single, double or multiple strapping.

I claim:

1. A machine for wrapping a strap around a package, the machine comprising:

a support frame;

first and second upright generally annular strap-guiding channels generally parallel to and flanking an upright plane, the channels each having a pair of confronting ends defining a respective gap, the gaps being immediately adjacent each other, the package being engageable within the annular channels;

a single guide block fittable in the gaps of the first and second channels and shiftable transversely of the plane between a single-loop position and a double-loop position, the guide block having a single-loop guide groove extending between the ends of the first channel in the single-loop position, the guide block further having first and second crossing double-loop guide grooves, the first double-loop guide groove in the dual-loop position extending between one of the ends of the first channel and one of the ends of the second channel and the second double-loop guide groove extending between the other of the ends of the first channel and the other of the ends of the second channel;

means for supplying a strap to the first channel such that, when the guide block is in the single-loop position, the strap passes only around the first channel, through the single-loop guide groove, and forms in the first channel a generally closed first loop and, when the guide block is in the dual-loop position, the strap forms first and second loops in the first and second channels; and means for tensioning the strap around the package engaged within the channels and for forming and sealing together ends of the strap at a location offset from the gaps.

2. The strapping machine defined in claim 1 wherein one of the first and second grooves of the second guide is deeper than the other of the first and second grooves of the guide block.

3. The strapping machine defined in claim 1 wherein the single-loop guide groove of the guide block is arcuate and the first and second double-loop guide grooves of the guide block are straight.

4. The strapping machine defined in claim 1 wherein the ends of the first and second channels are formed with tongues fittable with the grooves of the guide block.

5. A method of operating a machine for wrapping a strap around a package, the machine comprising:

a support frame;

first and second upright generally annular strap-guiding channels generally parallel to and flanking an upright plane, the channels each having a pair of confronting ends defining a respective gap, the gaps being immediately adjacent each other, the package being engageable within the annular channels;

a single guide block fittable in the gaps of the first and second channels and shiftable transversely of the plane between a single-loop position and a double-loop position, the guide block further having first and second crossing double-loop guide grooves, the first double-loop guide groove extending between one of the ends of the first channel and one of the ends of the second channel and the second double-loop guide groove extending between the other of the ends of the first channel and the other of the ends of the second channel;

the method comprising the steps of:

supplying a strap to the first channel;

for single-loop strapping, positioning the single guide block in the single-loop position such that the strap passes only around the first channel and forms therein a generally closed first loop or;

for double-loop strapping, positioning the single guide block in the double-loop position such that the strap forms first and second loops in the first and second channels; and tensioning the strap around the package engaged within the channels and sealing together ends of the strap at a location offset from the gaps.

* * * * *